US005234257A

United States Patent [19]

Sugden et al.

[11] Patent Number: 5,234,257

[45] Date of Patent: Aug. 10, 1993

[54] MOBILE MINING MACHINE HAVING TILTED SWING AXIS AND METHOD

[75] Inventors: David B. Sugden, Tasmania, Australia; John Turner, Renton, Wash.; Robert J. Boyd, Queensland, Australia

[73] Assignee: The Robbins Company, Kent, Wash.

[21] Appl. No.: 776,584

[22] Filed: Oct. 11, 1991

[51] Int. Cl.[5] ..... E21C 31/10; E21D 9/10

[52] U.S. Cl. ..... 299/10; 399/31; 399/33; 399/75

[58] Field of Search ..... 299/31, 33, 73, 75, 299/10, 11

[56] References Cited

U.S. PATENT DOCUMENTS

| | | | |
|---|---|---|---|
| 976,703 | 11/1910 | Seberg | 299/62 |
| 1,290,479 | 1/1919 | App | 37/190 |
| 2,776,824 | 1/1957 | Osterhus et al. | 299/75 |
| 3,290,095 | 12/1966 | Bredthauer | 299/57 |
| 3,307,879 | 3/1967 | Bergmann | 299/64 |
| 3,726,562 | 4/1973 | Wharton | 299/12 |
| 3,873,157 | 3/1975 | Stoltefuss et al. | 299/31 |
| 3,879,088 | 4/1975 | Sodder, Jr. et al. | 299/33 X |
| 3,929,378 | 12/1975 | Frenyo et al. | 299/64 |
| 3,965,995 | 6/1976 | Sugden | 175/57 |
| 4,035,024 | 7/1977 | Fink | 299/31 |
| 4,045,088 | 8/1977 | Bechem | 299/31 |
| 4,111,488 | 9/1978 | Signott et al. | 299/10 |
| 4,230,372 | 10/1980 | Marten | 299/39 |
| 4,312,541 | 1/1982 | Spurgeon | 299/31 |
| 4,548,442 | 10/1985 | Sugden et al. | 299/10 |
| 4,687,375 | 8/1987 | Gill | 299/31 X |

*Primary Examiner*—David J. Bagnell

*Attorney, Agent, or Firm*—Graybeal Jackson Haley & Johnson

[57] ABSTRACT

A mobile mining machine for cutting a tunnel in rock has a wheel-like cutterhead assembly supported by a pitch boom assembly that causes movement of the cutterhead assembly in the vertical plane. A swing boom assembly supports the pitch boom assembly and is supported by the main frame of the mobile mining machine. In one embodiment the swing boom assembly has a pivot axis that is tilted from vertical and swings the cutterhead and the pitch boom during mining to cut a tunnel having a wide, flat floor. During mining, a gripper assembly having a floor gripper shoe and a roof gripper shoe brace the mobile mining machine in the tunnel. Thrust is provided by thrust cylinders located between the gripper shoes and the main beam. Extension of the thrust cylinders moves the cutterhead assembly, main beam, and rear portion of the mobile mining machine forward relative to the gripper assembly due to slidable engagement of the main beam and gripper assembly. During re-gripping, the gripper cylinders and thrust cylinders are retracted, causing forward movement of the gripper assembly with respect to the main beam and rear portion of the machine.

22 Claims, 13 Drawing Sheets

MOBILE MINING MACHINE HAVING TILTED SWING AXIS AND METHOD

BACKGROUND OF THE INVENTION

The invention is in the field of mine tunneling machines, such as machines for cutting large variable cross-section mining tunnels having wide flat floors.

The most common known method of forming large mining tunnels in rock is the drill-and-blast method using explosives which has many disadvantages, one of which is that it is very hazardous. Thus, there has been a long-felt need for a mobile mining machine capable of successfully cutting large mining tunnels in rock by mechanical means in order to replace the use of explosives.

Several prior art patents show mining machines which appear to be capable of rotating a cutterhead about a horizontal axis and/or swinging it across a work face about a vertical axis. Typical of these are Osterhus et al., U.S. Pat. No. 2,776,824; Bergmann, U.S. Pat. No. 3,307,879; Frenyo et al., U.S. Pat. No. 3,929,378; Sigott et al., U.S. Pat. No. 4,111,488, and Marten, U.S. Pat. No. 4,230,372. All of these prior art patents disclose machines employing toothed or ripper cutter elements rather than disc cutters.

Bechem, U.S. Pat. No. 4,045,088 discloses a mining machine which is characterized by oscillation of a so-called drilling head about a vertical pivot axis to arcuately drive a slot cavity, the head and the rotatable disc cutters carried thereby being oscillated through a horizontal angle of about 120°. Plural disc cutters are canted in a diverging manner. No cutter movement is contemplated other than horizontal oscillation.

Stoltefuss et al., U.S. Pat. No. 3,873,157 discloses a tunneling or mining machine with the cutting device rotatably mounted on the forward end of a boom which is vertically and horizontally pivotable. The cutting arrangement involves two narrow wheels or rollers carrying pick-like cutters.

Also known is Wharton, U.S. Pat. No. 3,726,562 which discloses a coal mining machine having a cutterhead in the shape of a shallow cone rotatably mounted on the forward end of an elongate boom. The cutterhead, although not described in detail, appears to involve a series of picks as the cutting elements. It is not clear from the disclosure of the patent how the cutterhead is rotated and the patent disclosure does not contemplate any particular correlation between the rate of cutterhead rotation and the rate of cutterhead swing. The cutterhead is swingable both horizontally and vertically.

Spurgeon, U.S. Pat. 4,312,541 discloses a trench cutting machine comprising a main body assembly and a cutting wheel assembly. This coal mining machine moves plural rows of disc cutters horizontally about a substantially vertical facilitate discharge to a conveyor. A cylinder is mounted transversely on the main body assembly and carries a pair of pistons which extend axially from each end of the cylinder. Gripper pads are provided on each piston to bear against the side walls of the trench. Each piston has an end face within the cylinder which, together with an inner side wall of the cylinder, comprises a pressure chamber adapted to force the pads against the trench. The main body and its cylinder are free to move laterally relative to the pistons when the cylinder is pressurized. Extensible arms are provided between the pistons and the main body assembly for forcing the main body assembly and its cutting wheel forwardly to progessively cut a trench. A steering assembly is provided to shift the main body assembly laterally relative to the pistons and about the central axis of the cutting wheel.

Sugden et al., U.S. Pat. No. 4,548,442 teaches a mobile mining machine having a wheel-like cutterhead assembly and having a swing boom assembly located forward of a pitch boom assembly.

Co-pending U.S. patent application Ser. No. 07/706,052, including applicant Sugden of the subject application as a co-inventor, discloses a mobile mining machine having both a pitch boom assembly and a swing boom assembly in which the pitch boom assembly is attached to the cutterhead assembly, and the swing boom assembly is connected to the pitch boom assembly and to the mobile mining machine main frame. The above configuration allows the cutting of a tunnel having a low height to width ratio and optionally having no roof crown.

Co-pending U.S. patent application Ser. No. 07/701,503, including the applicants of the present application as inventors, discloses a mining machine in which a cutting wheel supporting a plurality of roller-cutters rotates about a horizontal axis and is supported on a slewing boom. The resulting tunnel has a flat floor and roof and elliptical walls. The slewing boom is supported on a main beam assembly, the front end of which rests on powered crawler tracks and the rear end of which passes through a gripper assembly which may be clamped between the floor and roof of the tunnel, and against which the main beam assembly may be urged forward for engaging the roller-cutters with the mining face. A preload crawler is urged against the roof of the tunnel above the powered crawler tracks to locate the main beam assembly rigidly relative to the tunnel such that the roller-cutters may cut the rock in the mining face with minimal loss of cutting force due to vibration.

Seberg, U.S. Pat. No. 3,976,703 discloses a cutting wheel supported on a pair of spaced supporting trucks, while App, U.S. Pat. No. 1,290,479 utilizes a chain-driven cutting wheel supported on a rail-mounted carriage. Auger-type cutters supported on a crawler-undercarriage form the basis of the mining machine disclosed by Bredthauer, U.S. Pat. No. 3,290,095. Fink, U.S. Pat. No. 4,035,024 utilizes roller-type cutters mounted on the periphery of a horizontal cutting wheel to cut a shallow trench in hard rock. While such roller-cutters are more effective and longer-lasting than picks in cutting hard rock, the cutting wheels could not slew, and the carriage supporting the wheels advanced against a support frame clamped to the walls of the trench.

A need thus exists for a mobile mining machine having a pitch boom assembly and a swing boom assembly in which the swing axis is tilted relatively forward, away from vertical. The tilted swing axis of the present invention thus cuts tunnels having large, variable cross-sections and wide, flat floors.

A need also exists for a mobile mining machine having the above described tilted swing boom that is convertible into a swing boom having a substantially vertical swing axis.

SUMMARY OF THE INVENTION

A mobile mining machine for cutting a tunnel in rock including a wheel-like cutterhead assembly having a substantially horizontal axis of rotation and multiple peripherally mounted roller cutters is disclosed. A power unit rotates the cutterhead assembly. A pitch boom assembly supports the cutterhead assembly and causes movement of the cutterhead assembly in a vertical plane. A swing boom assembly supports the pitch boom assembly and swings the cutterhead assembly. The swing boom assembly has an axis that is tilted at an angle from the vertical axis of the main beam of the mining machine to cut a tunnel having a wide flat floor.

The main beam, in addition to mounting the cutterhead, swing boom assembly and pitch boom assembly, also mounts the muck apron and muck blades, the rolling roof stabilizer, the front crawlers, the forward muck conveyor and the gripper assembly of the mobile mining machine.

The front crawlers are hydraulically powered units which both carry the dead weight of the main machine and stabilize the cutting wheel. In combination with the unpowered but hydraulically energized rolling roof stabilizer, the front crawlers react vertical and horizontal forces of the cutting wheel while allowing it to move longitudinally as the excavation proceeds. Rear crawlers are also present.

The rolling roof stabilizer consists of a stabilizer plate, which is in contact with the tunnel roof, and a stabilizer support structure. The stabilizer plate remains pressed against the roof during the boring cycle. The rollers between the plate and the stabilizer support structure allow the machine to slide forward, while maintaining full vertical stabilizing pressure. During re-gripping, the front roof stabilizer is depressurized and the stabilizer plate is reset forward by a link between the guide and the gripper assembly The gripper assembly includes hydraulic cylinders connected to a pair of gripper shoes, one for the roof and one for the floor. A gripper carrier weldment comprised of two plates sandwich the hydraulic gripper cylinders. When the gripper cylinders are energized, the gripper shoes anchor securely to the roof and floor. Thrust is developed directly from these gripper shoes by the thrust cylinders, which interconnect the gripper shoes and main beam. The longitudinal guide portion of the rear of the beam is mounted in the floating gripper carrier weldment that is incorporated in the gripper assembly. The gripper assembly, and specifically the floating gripper carrier weldment, provides a fixed anchor on the roof and floor of the bored tunnel but allows the longitudinal guide portion of the main beam to slide forward during thrusting. At the end of each stroke the gripper cylinders are retracted, transferring the weight of the rear of the machine and allowing the gripper cylinders to be cycled forward with the gripper carrier weldment relative to the main beam. Gripper ways on the gripper carrier weldment and mating gripper grooves on the main beam allow this relative movement between the gripper assembly and main beam. The gripper shoes are then regripped on the rock and the new boring cycle can commence.

Boring is accomplished by advancing the cutterhead (plunging) incrementally as the cutterhead completes each sweep across the face. The systematic cycle of plunging and swinging is performed continuously through the length of one propel stroke. Alteration of the vertical and horizontal positioning of the machine is accomplished by changing the positioning of the rear of the main beam within the gripper assembly. Muck is moved from the face by the crowding action of the muck blades which directs the muck toward the centrally located forward belt conveyor. The forward belt conveyor carries the muck to the rear of the machine. An equipment deck is mounted on the rear platform assembly. The transformer, air scrubber, control station, hydraulic and electric equipment and loading conveyor are all located on the equipment deck.

BRIEF DESCRIPTION OF THE DRAWINGS

These and other features of the present invention will be evident when considered in light of the following specification and drawings in which.

DETAILED DESCRIPTION OF THE PREFERRED EMBODIMENTS

Figure 1:
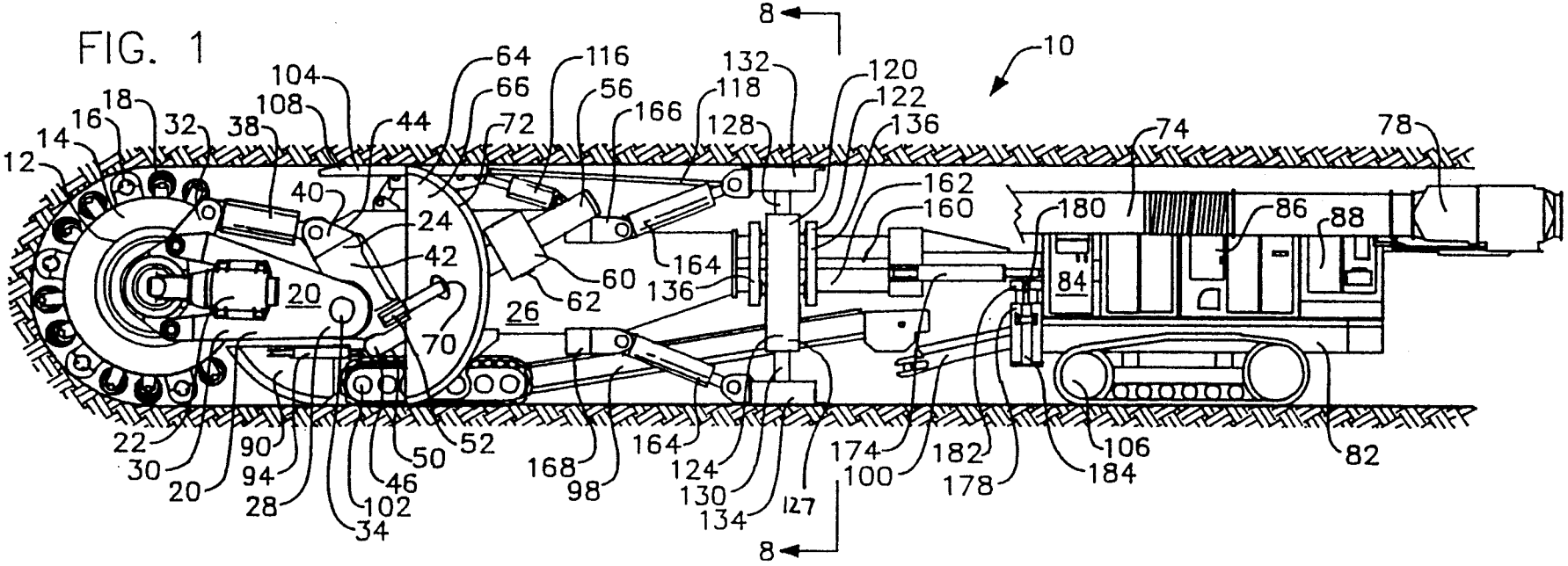
FIG. 1 is a side elevational view of a first embodiment of a mobile mining machine having a tilted swing axis typifying the present invention.
Figure 2:
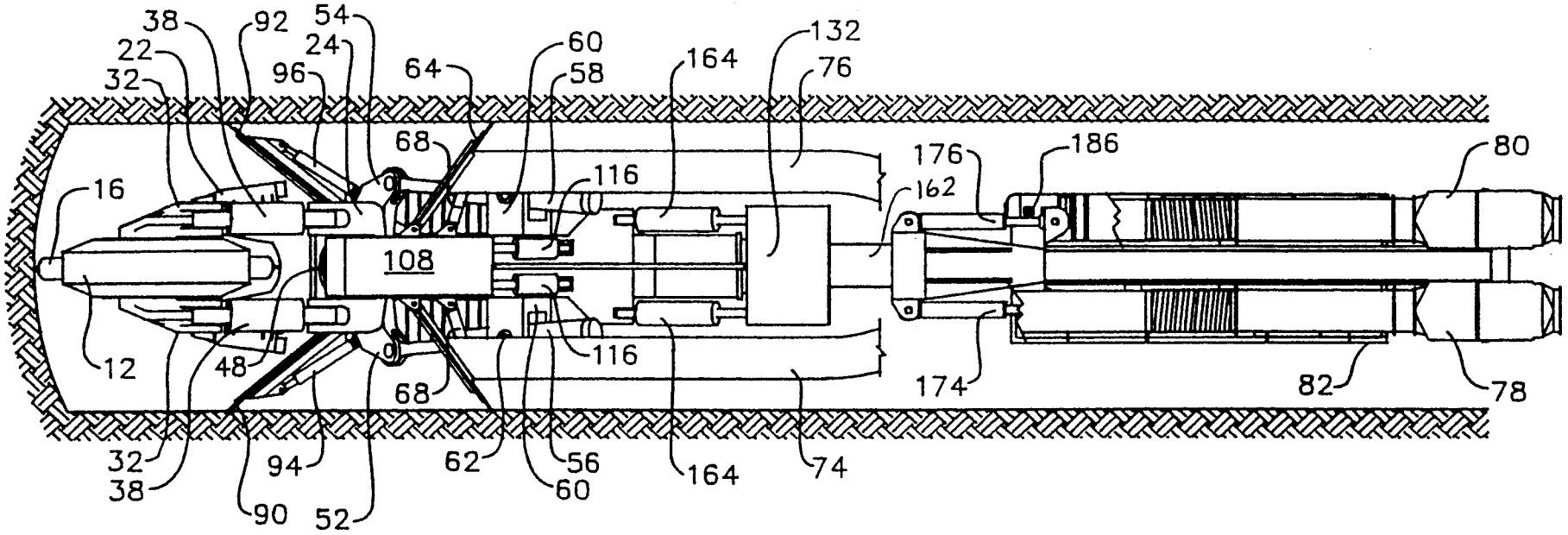
FIG. 2 is a top view of the mobile mining machine of FIG. 1.
Figure 3:
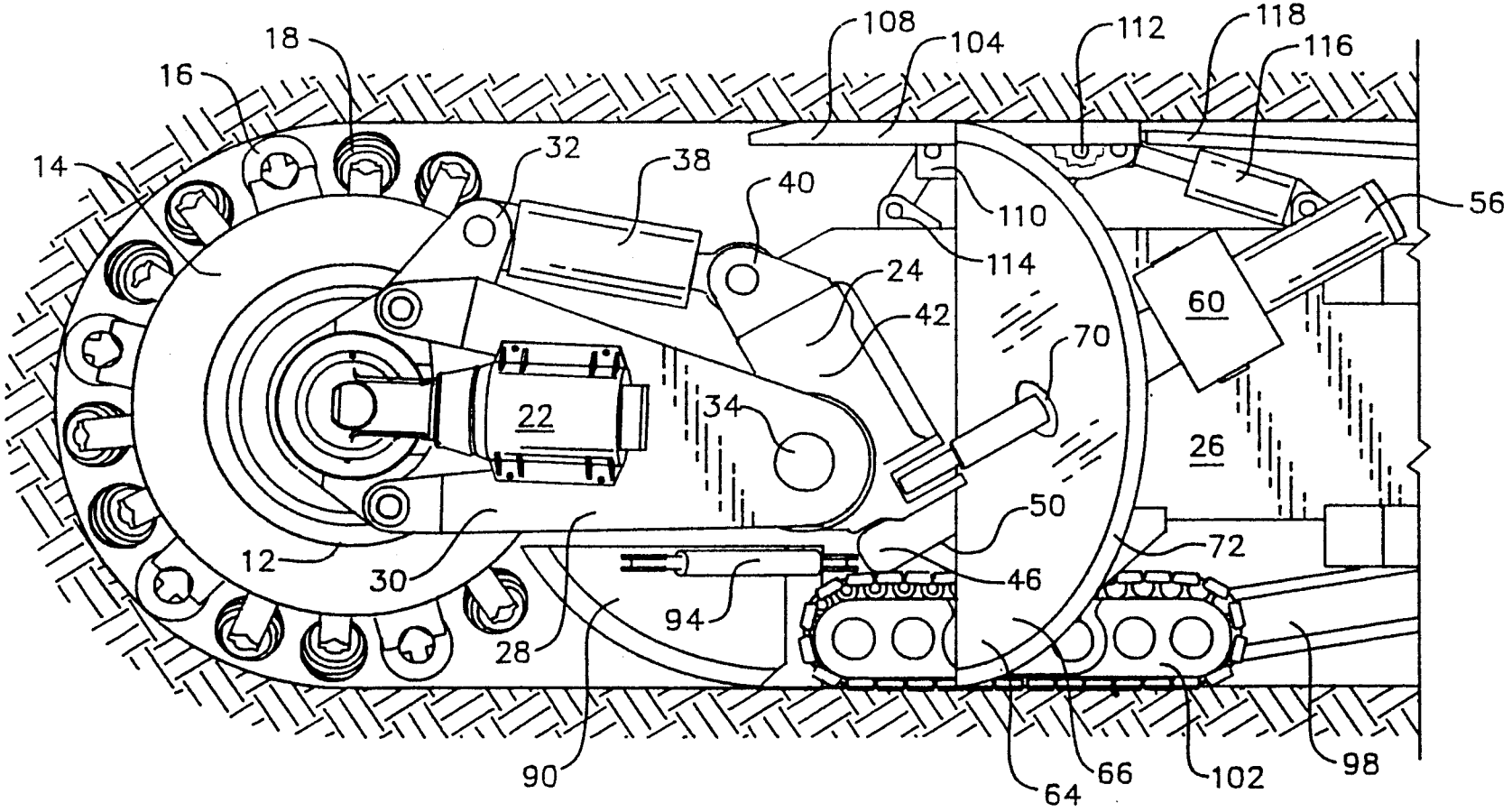
FIG. 3 is an enlarged portion of FIG. 1 showing the front section of the mobile mining machine of FIG. 1.
Figure 4:
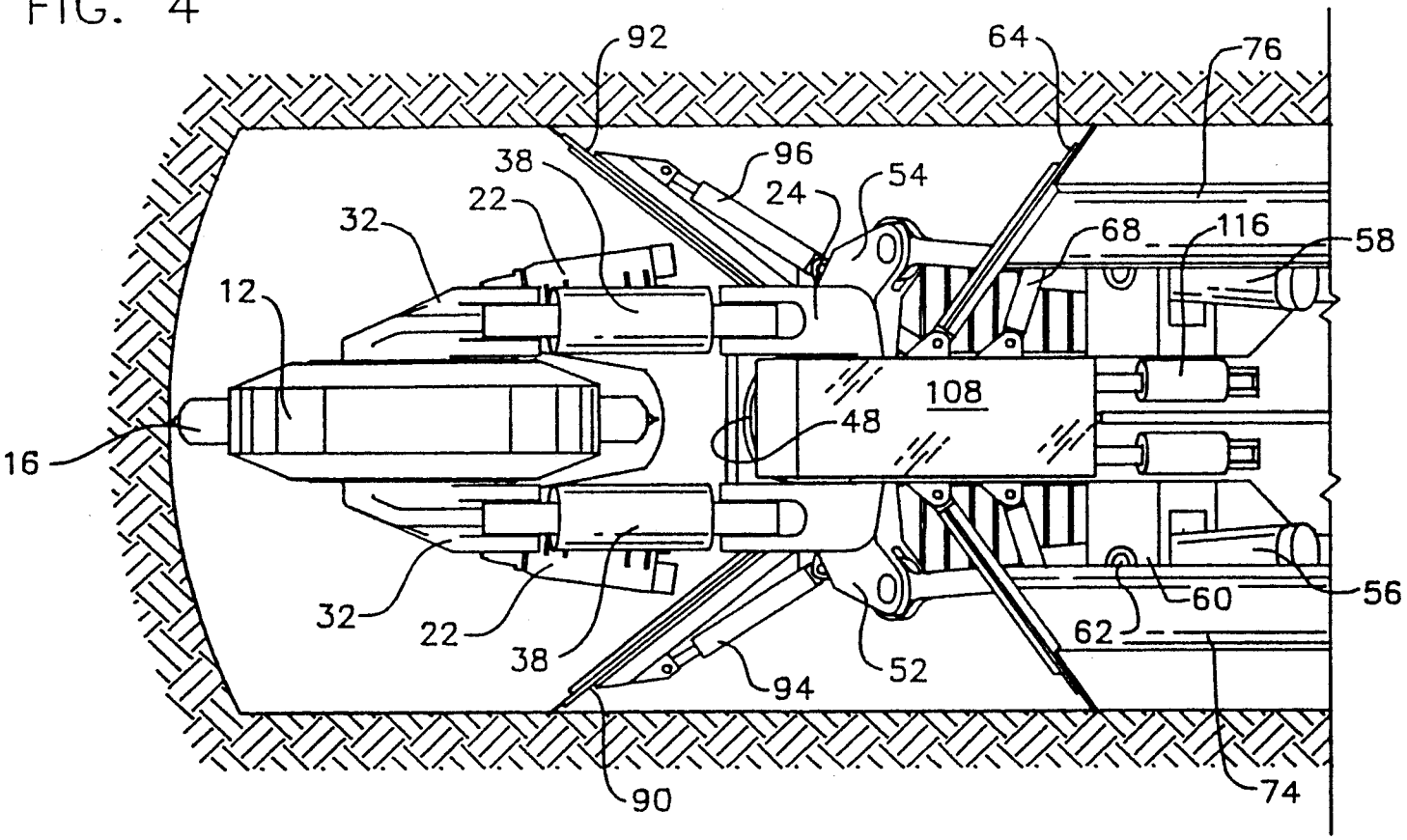
FIG. 4 is an enlarged portion of FIG. 2 showing the front section of the mobile mining machine of FIG. 2.
Figure 5:
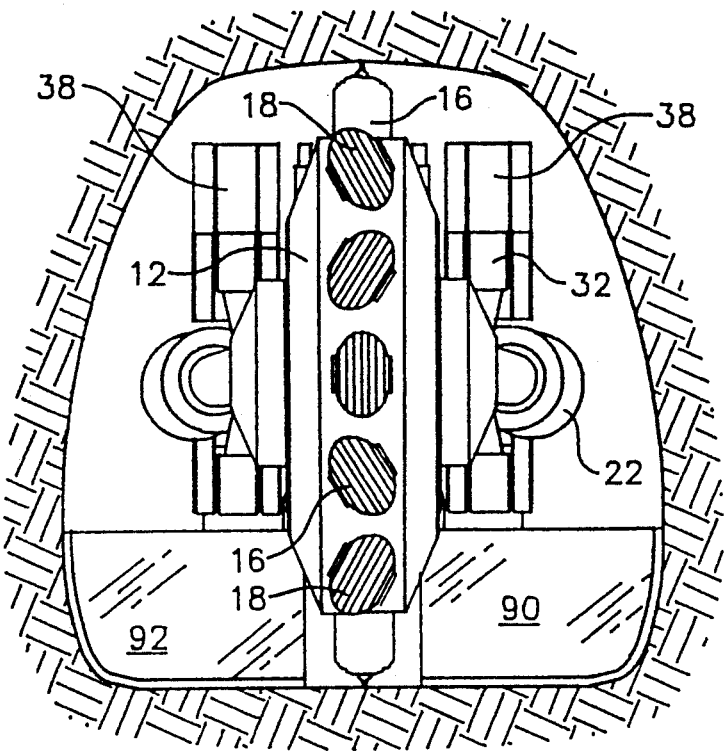
FIG. 5 is a front view of the mobile mining machine of FIG. 1.
Figure 6:
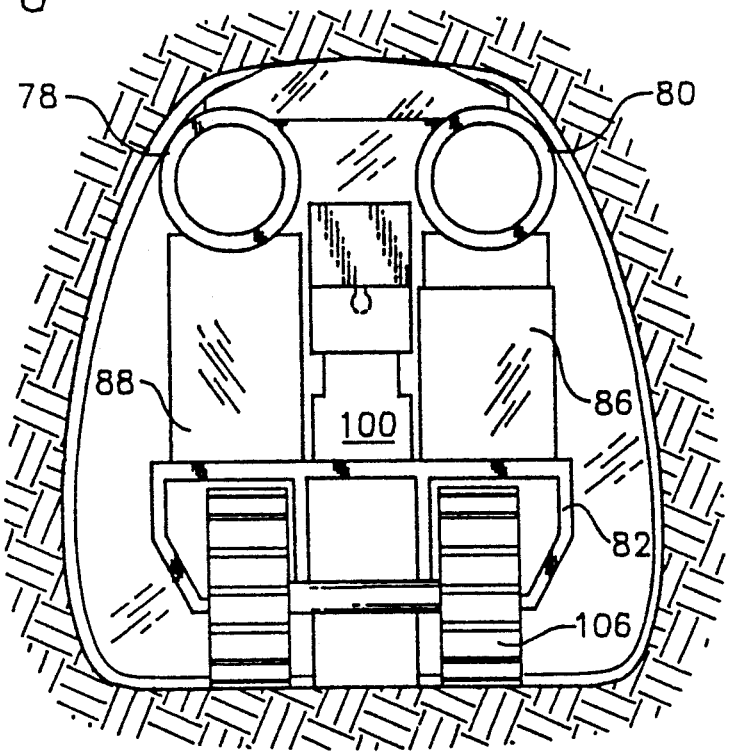
FIG. 6 is a rear view of the mobile mining machine of FIG. 1.

Referring to FIGS. 1 through 8, a first embodiment of the invention is a mobile mining machine 10 which includes a wheel-like cutterhead assembly 12. The term "mobile mining machine" is to be construed as including machines employed in any and all of mining, tunneling and excavation operations. The cutterhead assembly or cutter wheel 12 consists of a transverse horizontal axis wheel-like drum 14 on which are peripherally mounted a plurality of disc cutters 16 and gauge cutters 18. Drum 14 is rotatably connected to pitch boom assembly 20. Drum 14 is powered by electric or hydraulic drive motor 22 employing gearing and drive trains known in the art.

As disclosed in U.S. Pat. No. 4,548,442 issued to Sugden et al., cutterhead assembly 12 generates the work face profile by plunging forward and moving from side to side as controlled by swing boom assembly 24. Additionally, pitch boom assembly 20 adjusts the vertical orientation of cutterhead assembly 12 for vertical cuts. If arcuate or angled cuts are desired, both swing boom assembly 24 and pitch boom assembly 20 are simultaneously employed.

Main beam 26 is an elongate member having a longitudinal axis disposed substantially parallel with the tunnel, and a vertical axis disposed substantially perpendicular to the longitudinal axis.

Swing boom assembly 24 is mounted on main beam 26 such that swing boom assembly 24 pivots on an axis angled from vertical as described in further detail below. Pitch boom assembly 20 connects cutterhead assembly 12 and swing boom assembly 24. Specifically, pitch boom assembly 20 is comprised of pitch boom 28, which is attached to cutterhead assembly 12 such that cutterhead assembly 12 has freedom of rotation relative thereto. Pitch boom 28 is preferably comprised of four pitch boom arms 30, with left upper pitch boom arm, left lower pitch boom arm, right upper pitch boom arm, and right lower pitch boom arm. Each of pitch boom arms 30 is attached to cutterhead assembly 12 by cutterhead lugs 32 such that cutterhead assembly 12 has free rotation relative to pitch boom 28. The ends of pitch boom arms 30 not attached to cutterhead assembly 12 are all interconnected with swing boom assembly 24 by pitch bearing 34. Specifically pitch bearing 34 allows vertical movement of pitch boom arms 30 about a horizontal axis through pitch bearing 34 and relative to main beam 26. Pitch cylinders 38 and specifically the left pitch cylinder and right pitch cylinder are both connected to lugs 32 of pitch boom arms 30. The ends of pitch cylinders 38 not connected with lugs 32 are fixedly attached to pitch cylinder clevises 40.

Thus, extension of the left pitch cylinder and right pitch cylinder causes relative downward movement of pitch boom 28 and cutterhead assembly 12 with respect to mobile mining machine 10. Alternatively, retraction of the left pitch cylinder and right pitch cylinder causes relative upward movement of pitch boom 28 and cutterhead assembly 12.

Describing swing boom assembly 24 in detail, swing boom 42 is rotatably secured to the front portion of main beam 26 by upper flange 44 and lower flange 46 of main beam 26. Swing boom 42 is preferably an elongate tubular member rotatable about its longitudinal axis. Residing in upper flange 44 and lower flange 46 respectively are upper swing bearing 48 and lower swing bearing 50. On opposite sides of swing boom 42 are left swing cylinder clevis 52 and right swing cylinder clevis 54, located adjacent to lower flange 46. Left swing cylinder clevis 52 secures left swing cylinder 56 to swing boom 42, and right swing cylinder clevis 54 secures right swing cylinder 58 to swing boom 42. Left swing cylinder 56 and right swing cylinder 58 are both secured to main beam 26 by swing cylinder brackets 60 having bracket pin 62 passing therethrough. Thus, extension of left swing cylinder 56 and retraction of right swing cylinder 58 results in swinging of swing boom 42 and cutterhead assembly 12 in the right hand direction. Alternatively, extension of right swing cylinder 58 and retraction of left swing cylinder 56 causes swinging of swing boom 42 and cutterhead assembly 12 in the left hand direction. It is important to note that swing boom 42 is attached to main beam 26 such that the longitudinal axis of swing boom 42 is disposed at an angle from the vertical axis of main beam 26, with the top portion of swing boom 42 oriented closer to cutterhead assembly 12 than the bottom portion of swing boom 42. The axis of rotation of swing boom 42 is preferably thus tilted at an angle of about 30° from vertical. However, the present invention contemplates orientation of axis of rotation of swing boom 42 between about 10° and about 45° from vertical. The slope of the linear relationship of the tunnel flat floor width versus the excavation width is a function of the tilt angle of the axis of rotation of swing boom 42, and this slope will vary as the tilt angle of swing boom 42 is altered.

The dust suppression system consists of a retractable shield 64 having two wings 65, one located on each side of main beam 26. Shield swing cylinders 68, one being attached to each of wings 65 and to main beam 26, cause movement of shield 64 from a retracted position to an extended position in order to suppress dust during mining operations. Opening 70 in wings 66 allows passage of left swing cylinder 56 and right swing cylinder 58 through shield 64. Shield 64 also includes a skirt 72 around the perimeter thereof that contacts the tunnel wall for a tight seal.

The scrubber system of mobile mining machine 10 includes left scrubber exhaust duct 74 and right scrubber exhaust duct 76 located adjacent shield 64 near the front of mobile mining machine 10 in order to gather particulate matter. Left scrubber exhaust duct 74 and right scrubber exhaust duct 76 communicate, respectively, with left scrubber 78 and right scrubber 80 located on each side of rear platform 82. Rear platform 82 carries operator's cab 84, hydraulic control cabinets 86, and electrical control cabinets 88, all known in the art.

Referring now to the muck handling system of the present invention, left muck blade 90 and right muck blade 92 are pivotally secured to the front portion of main beam 26. Left muck swing cylinder 94 and right muck swing cylinder 96 are oriented between main beam 26 and left muck blade 90 and right muck blade 92, respectively. Cyclical extension and retraction of left muck swing cylinder 94 and right muck swing cylinder 96 causes sweeping movement of left muck blade 90 and right muck blade 92 to center the muck under the front portion of main beam 26, where the muck is fed onto forward conveyor 98. Aft conveyor 100 underlaps forward conveyor 98 at the rear portion thereof, and receives muck from forward conveyor 98. The rear portion of rear conveyor 100 loads muck into a muck hopper (not shown).

The locomotion, thrusting, and gripping systems of mobile mining machine 10 are next described. Front crawlers 102 are hydraulically powered units which both carry the dead weight of mobile mining machine 10 and function as stabilizers for cutterhead assembly 12. In combination with the unpowered but hydraulically energized rolling roof stabilizer 104, the front crawlers react vertical and horizontal movements of the cutterhead assembly 12 while allowing it to move longitudinally as the excavation proceeds. Rear crawlers 106 support rear platform 82 and may either be powered or unpowered units known in the art.

Rolling roof stabilizer 104 is comprised of a plate 108 oriented to contact the roof of the tunnel during excavation. Plate 108 is attached to support 110 by means of a plurality of rollers 112 such that plate 108 is slidable on rollers 112 with respect to support 110. Support 110 is pivotally secured to main beam 26 by support clevis 114, which attach the front portion of support 110 to main beam 26, and by stabilizer gripper cylinders 116, which are secured to the rear portion of support 110. Link 118 attaches the rear portion of plate 108 to gripper assembly 120. During mining, plate 108 is urged against the tunnel roof by stabilizer gripper cylinder 116 and support 110. Support 110 moves forwardly with main beam 26 on rollers 112 as plate 108 remains in place. In this manner, rolling roof stabilizer 104 allows mobile mining machine 10 to slide forward while maintaining full vertical stabilizing pressure. During regripping, stabilizer gripper cylinders 116 are depressurized and plate 108 moves forwardly on rollers 112 relative to support 110 and main beam 26 as gripper assembly 120 moves forwardly. This tandem forward motion of plate 108 and gripper assembly 112 is facilitated by link 118 located therebetween.

Gripper assembly 120 includes gripper carrier weldment 122 sandwiching left gripper cylinder 124 and right gripper cylinder 126. Both left gripper cylinder 124 and right gripper cylinder 126 have a barrel 127 with an upper gripper cylinder rod 128 and a lower gripper cylinder rod 130 therein. In order to alter the vertical orientation of barrels 127, the hydraulic pressure in barrels 127 adjacent to one or both of upper gripper cylinder rods 128 and/or adjacent to one or both of lower gripper cylinder rods 130 can be altered. In this manner, the vertical position of main beam 26 can be varied, and main beam 26 can be rotated about a horizontal axis, as described below. Upper anchor shoe 132 is secured to upper gripper cylinder rods 128 and lower anchor shoe 134 is attached to lower gripper cylinder rods 130 such that mobile mining machine 10 can be braced in the tunnel during mining by extension of left gripper cylinder 124 and right gripper cylinder 126.

Figure 7:
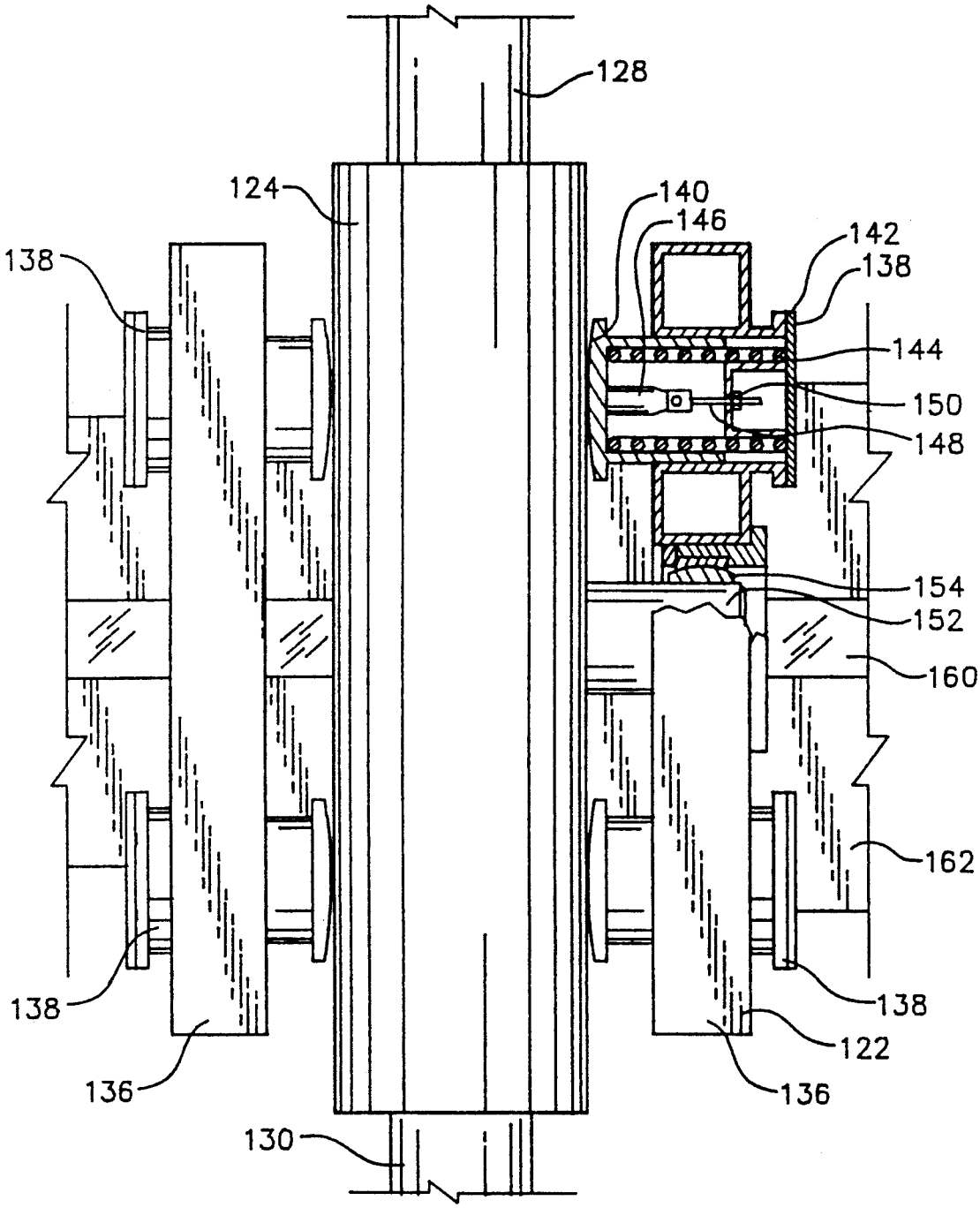
FIG. 7 is a partially exposed, detailed view of the gripper assembly of the mobile mining machine of FIG. 1.
Figure 8:
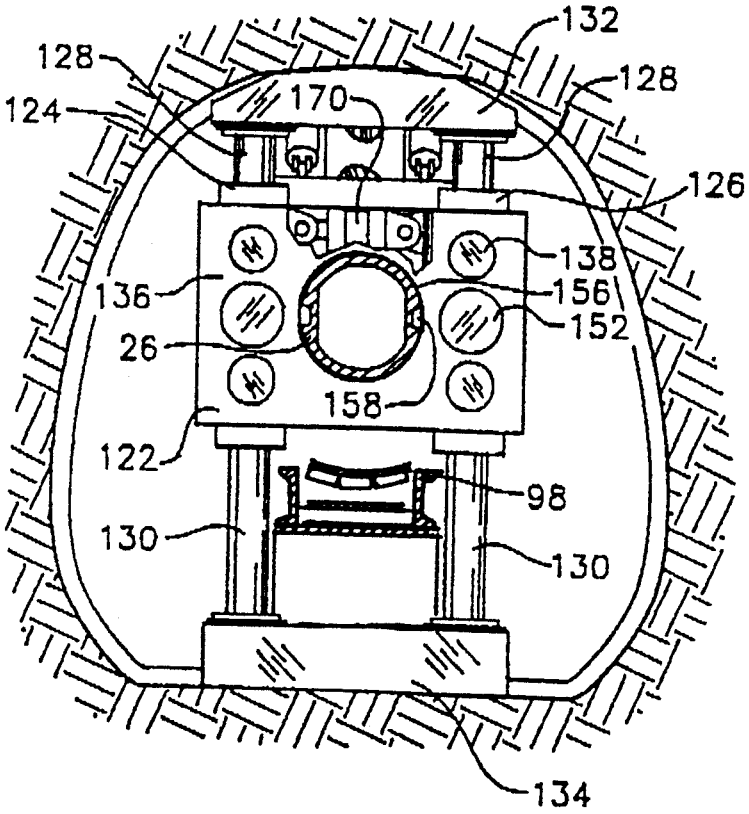
FIG. 8 is a cross-sectional view of the mobile mining machine of FIG. 1 taken at lines 8—8.

As shown in FIGS. 7 and 8, gripper carrier weldment 122 is comprised of a pair of plates 136 that brace left gripper cylinder 124 and right gripper cylinder 126 therebetween. Four spring bumpers 138 pass through each of plates 136. Spring bumpers 138 of each of plates 136 are aligned thereon such that each spring bumper 138 provides a force that is opposed by a spring bumper 138 on the opposite plate 136 such that gripper carrier weldment 122 is secured on left gripper cylinder 124 and right gripper cylinder 126. Each spring bumper 138 includes a bumper shoe 140 located adjacent to one of left gripper cylinder 124 and right gripper cylinder 126. Cap 142 of spring bumper 138 secures spring bumper 138 to one of plates 136 of gripper carrier weldment 122. Spring bumpers 138 each include a spring 144 therein and a retainer 146 on which is a threaded rod 148 and nut 150 employed to set the spring load of spring bumpers 138.

Again referring to FIGS. 7 and 8, the plate 136 of gripper carrier weldment 122 that is farther aft on mobile mining machine 10 is pivotally attached to left gripper cylinder 124 and right gripper cylinder 126 by trunnions 152. The pivotal movement between trunnions 152 and plate 136 is facilitated by bushings 154 between trunnions 152 and plate 136. As described in further detail below, the pivotal movement between trunnions 152 and plate 136 of gripper carrier weldment 122 allows movement of main beam 26 in the transverse direction relative to mobile mining machine 10.

Gripper carrier weldment 122 includes main beam opening 156 in the center thereof and through which main beam 26 passes. Gripper ways 158 are located on each side of main beam opening 156 and mesh with gripper grooves 160 which are longitudinally disposed on elongate guide portion 162 of main beam 26. Relative reciprocation between main beam 26 and gripper carrier weldment 122 thus occurs due to the meshing of gripper ways 158 of gripper carrier weldment 122 with gripper grooves 160 of elongate guide portion 162.

Thrust cylinders 164 are fixedly secured between main beam 26 and either upper anchor shoe 132 or lower anchor shoe 134. Specifically, top left thrust cylinder 164 and top right thrust cylinder 164 are attached to upper anchor shoe 132 and to one of the top thrust cylinder clevises 166 of main beam 26. The bottom left thrust cylinder 164 and bottom right thrust cylinder 164 are secured to lower anchor shoe 134 and to one of the bottom thrust cylinder clevises 168 of main beam 26.

During mining, mobile mining machine 10 is "gripped" in the tunnel to secure it so that a mining stroke can be performed. Left gripper cylinder 124 and right gripper cylinder 126 are extended such that upper anchor shoe 132 and lower anchor shoe 134 are firmly braced against the tunnel wall. Additionally, stabilizer gripper cylinders 116 are energized such that plate 108 of rolling roof stabilizer 104 is braced against the tunnel roof. In this configuration, rolling roof stabilizer 104 in combination with front crawlers 102 react vertical and horizontal forces of cutter assembly 12 while allowing it to move longitudinally as mining proceeds. As thrust cylinders 164 are energized, main beam 26, rear platform 82 and cutterhead assembly 12 move forward on front crawlers 102, on rolling roof stabilizer support 110 and on rear crawlers 106, and with respect to gripper assembly 120 and rolling roof stabilizer plate 108. The relative movement of main beam 26 with respect to gripper assembly 120 occurs as the elongate guide portion 162 of main beam 26 slides forward in gripper carrier weldment 122 of gripper assembly 120 by means of gripper grooves 160 longitudinally disposed on elongate guide portion 162. As stated above, gripper grooves 160 mate with gripper ways 158 of gripper carrier weldment 122.

The above extension of thrust cylinders 164 forces cutterhead assembly 12 into the rock face at a location previously established by actuation of pitch cylinders 38. During the mining sweep, tilted swing boom 42 is swept in either a left to right or a right to left direction by actuation of left swing cylinder 56 and right swing cylinder 58. Alternatively, if a vertical cut or a cut with a vertical component is desired, pitch boom 28 is employed instead of or along with swing boom 42. As will be apparent, any desired arcuate or angled cut may be realized with pitch boom 28 and swing boom 42 being pivotally actuated selectively.

After the mining stroke is completed, mobile mining machine 10 is configured for "regripping", in which mobile mining machine 10 is repositioned for the next mining stroke. Left gripper cylinder 124 and right gripper cylinder 126 are retracted, thus disengaging upper anchor shoe 132 and lower anchor shoe 134 from the tunnel. Thrust cylinders 164 are retracted, as are stabilizer cylinders 116. As a result, gripper assembly 120 moves forward relative to main beam 26 as gripper carrier weldment 122 of gripper assembly 120 travels along gripper grooves 160 of main beam 26 by means of gripper ways 158. Left hitch support cylinder 184 and right hitch support cylinder 186, described in detail below, are extended to support main beam 10 as gripper assembly 120 is retracted. Additionally, rolling roof stabilizer plate 108 moves forward relative to main beam 26 and rolling roof stabilizer support 110 on rollers 112 due to interconnection of rolling roof stabilizer plate 108 and gripper assembly 120 by link 118. Mobile mining machine 10 is now "regripped" for another mining stroke, or may, alternatively, be trammed to another location on front crawlers 102 and rear crawlers 106 since upper anchor shoe 132 and lower anchor shoe 134 no longer contact the tunnel.

The steering of, and positioning of various components of, mobile mining machine 10 is now described. The vertical position of main beam 26 can be varied by selectively altering the vertical position of both barrels 127 of left gripper cylinder 124 and right gripper cylinder 126 in tandem through selectively varying the hydraulic pressure in barrels 127 adjacent to both of upper gripper cylinder rods 128 and/or adjacent to both of lower gripper cylinder rods 130. Alteration of the vertical position of barrels 127 in tandem changes the vertical position of gripper assembly 120, and main beam 10. Main beam 26 is thus tilted relative to the longitudinal axis of the tunnel, with gripper assembly 120 acting as the fulcrum.

To rotate main beam 26 about a horizontal axis, gripper assembly 120 is likewise rotated by selectively altering the vertical position of either, or both, of barrels 127 of left gripper cylinder 124 and right gripper cylinder 126 such that barrels 127 are not moved in tandem but instead are moved to different heights above the tunnel floor with respect to each other.

The transverse direction of mining is altered by implementation of the following elements of mobile mining machine 10. Referring specifically to FIGS. 7 and 8, upper horizontal steering cylinder 170 is sandwiched between plates 136 of gripper carrier weldment 122 and interconnects gripper carrier weldment 122 with left gripper cylinder 124. Lower horizontal steering cylinder (not shown) is sandwiched between plates 136 of gripper carrier weldment 122 and interconnects gripper carrier weldment 122 with right gripper cylinder 126. The lower horizontal is identical in construction to upper horizontal steering cylinder 170. As stated above, plate 136 of gripper carrier weldment 122 that is farthest aft on mobile mining machine 10 is pivotally attached to left gripper cylinder 124 and right gripper cylinder 126 by means of trunnions 152. These pivotal attachments are facilitated by bushing 154. In order to alter the transverse orientation of main beam 26 of mobile mining machine 10 towards the right hand side of the tunnel face, upper horizontal steering cylinder 170 is extended and lower horizontal steering cylinder is retracted, thus urging gripper carrier weldment 122 and main beam 26 in a right handed direction relative to the tunnel face. Specifically, extension of upper horizontal steering cylinder 170 results in rotation of left gripper cylinder 124 in a counterclockwise direction (as viewed from above) around an axis of rotation located in trunnion 152. This counterclockwise rotation of left gripper cylinder 124 results in pivotal movement of trunnion 152 in bushing 154, thus urging gripper carrier weldment 122 in a right handed direction due to the attachment of trunnion 152 with one of plates 136 of gripper carrier weldment 122. Simultaneously, retraction of lower horizontal steering cylinder results in counterclockwise rotation of right gripper cylinder 126 (as viewed from above) about an axis of rotation in the other trunnion 152. This counterclockwise rotation results in pivotal movement of trunnion 152 by means of bushing 154 such that trunnion 152 forces plate 136 of gripper carrier weldment 122 in a right handed direction. In order to move main beam 26 of mobile mining machine 10 in a left handed direction relative to the tunnel face, gripper carrier weldment 122 is moved in a left handed direction by retraction of upper horizontal steering cylinder 170 and lower horizontal steering cylinder which results in clockwise rotation (as viewed from above) of both left gripper cylinder 124 and right gripper cylinder 126. This clockwise rotation of left gripper cylinder 124 and right gripper cylinder 126 results in pivotal movement of trunnions 152 in bushings 154 in a direction opposite to the above-described pivotal movement employed to move main beam 26 in a right handed direction.

Again referring to FIGS. 1 and 2, steering during tramming between main beam 26 and rear platform 82 is controlled by left aft steering cylinder 174 and right aft steering cylinder 176, which are located between main beam 26 and rear platform 82. Extension (or retraction) of left aft steering cylinder 174 and the accompanying retraction (or extension) of right aft steering cylinder 176 varies the steering angle between main beam 26 and rear platform 82. Rear platform 82 pivots with respect to main beam 26 around ball and socket hitch 178, which is comprised of ball 180 located on the aft end of elongate guide portion 162 of main beam 126, and socket 182 located on the fore portion of rear platform 82.

Left hitch support cylinder 184 and right hitch support cylinder 186 are located on the fore portion of rear platform 82 adjacent socket 182, and abut the underside of the aft end of elongate guide portion 162 of main beam 26. Extension and retraction of left hitch support cylinder 184 and right hitch support cylinder 186 maintains the relative position of forward conveyor 98 and rear conveyor 100 on uneven terrain by altering the relative orientation of main beam 26 and rear platform 82. Also, as stated above, left hitch support cylinder 184 and right hitch support cylinder 186 are extended to support main beam 10 during "regripping" when gripper assembly 120 is retracted.

Figure 9:
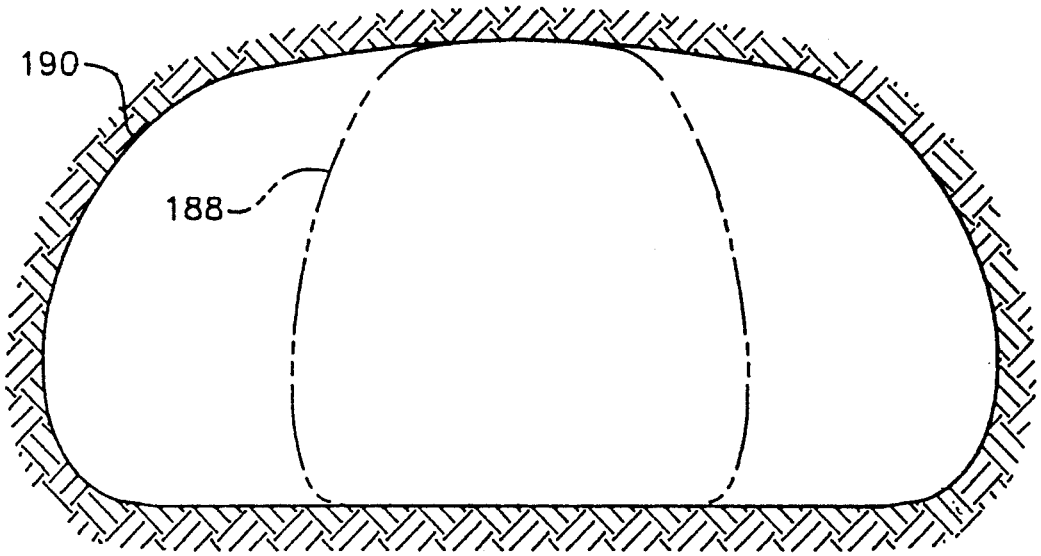
FIG. 9 is a cross-sectional view of the maximum tunnel and the minimum tunnel cut with the mobile mining machine of FIG. 1.

FIG. 9 shows the shapes and relative tunnel sizes of the minimum tunnel 188 and the maximum tunnel 190 above to be mined by mobile mining machine 10. It is readily apparent that mobile mining machine 10 can mine a tunnel any shape and size between minimum tunnel 188 and maximum tunnel 190. It is to be noted that the tunnels mined by mobile mining machine 10 preferably have wide flat floors. For these tunnels, a linear relation exists between the tunnel excavation width and the flat floor width such that the flat floor width is a fixed percentage of the excavation width, regardless of the total cross-sectional area of the tunnel. The slope of this linear relationship (that defines the percentage of tunnel excavation width equal to the flat floor width) is a function of the angle from vertical of the tilt of the axis of rotation of swing boom 42, as well as of the length of pitch boom 28.

Referring now to FIGS. 10 through 16, a second embodiment of the mobile mining machine 10 of the present invention is disclosed. The element numbers of FIGS. 10 through 16 are the same as the elements numbers of the first embodiment of FIGS. 1 through 9 when common elements are shown. When elements similar to those of the figures of the first embodiment are shown in the figures of the second embodiment, a prime has been added to the element number (e.g. 24').

The second embodiment of the present invention is a convertible mobile mining machine 10' substantially the same as mobile mining machine 10 of the first embodiment except that swing boom assembly 24' of the second embodiment is convertible between a tilt mode, in which the longitudinal axis of swing boom 42' is oriented at an angle from vertical, and a vertical mode in which the longitudinal axis of swing boom 42' is vertical.

FIGS. 10 through 13 show the tilt mode of mobile mining machine 10'. Tilt adapter 192 is fixedly secured between swing boom assembly 24' and the fore portion of main beam 26'. Specifically, flanges 194 on both ends of tilt adaptor 192 fit flushly with flanges 196 on swing boom assembly 24' and flanges 198 on main beam 26'. Flanges 194, 196 and 198 are secureably attached by a plurality of bolts or the like. Tilt adaptor 192 preferably orients the axis of rotation of swing boom 42' at about 30° from vertical. However tilt adaptor 192 can be configured to orient the axis of rotation of swing boom 42' between about 10° and about 45° from vertical.

When in the above-described tilt mode, mobile mining machine 10' mines a tunnel having a low, wide floor as shown in FIG. 9 above and described in regard to the first embodiment of the present invention.

Figure 10:
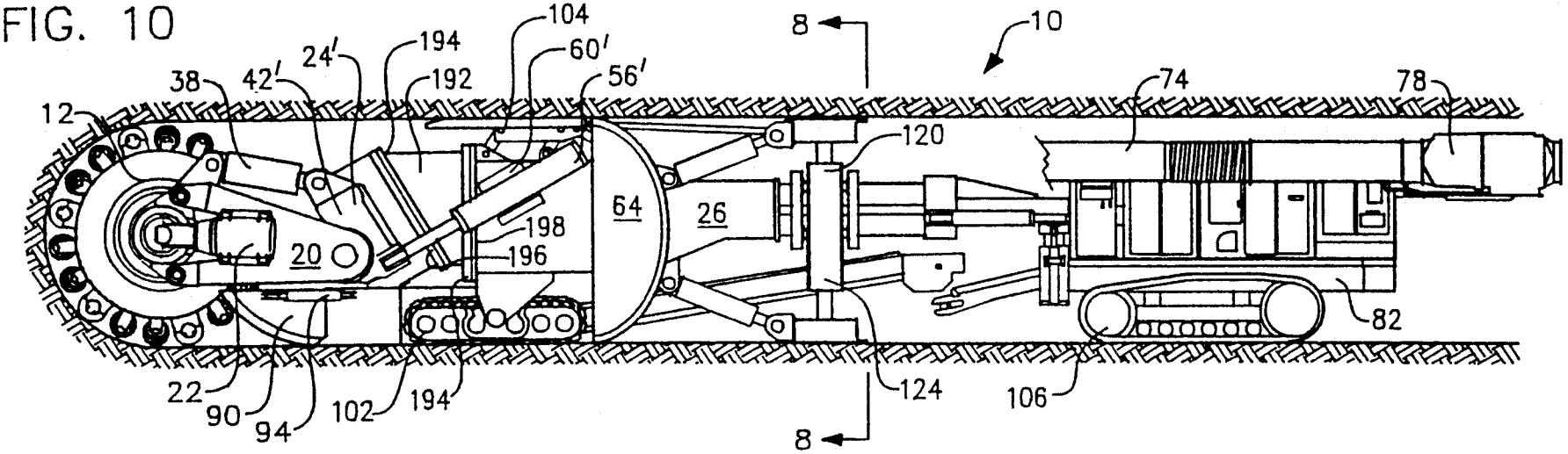
FIG. 10 is a side elevational view of a second embodiment of a mobile mining machine showing a convertible swing boom assembly in the tilted swing axis configuration.
Figure 11:
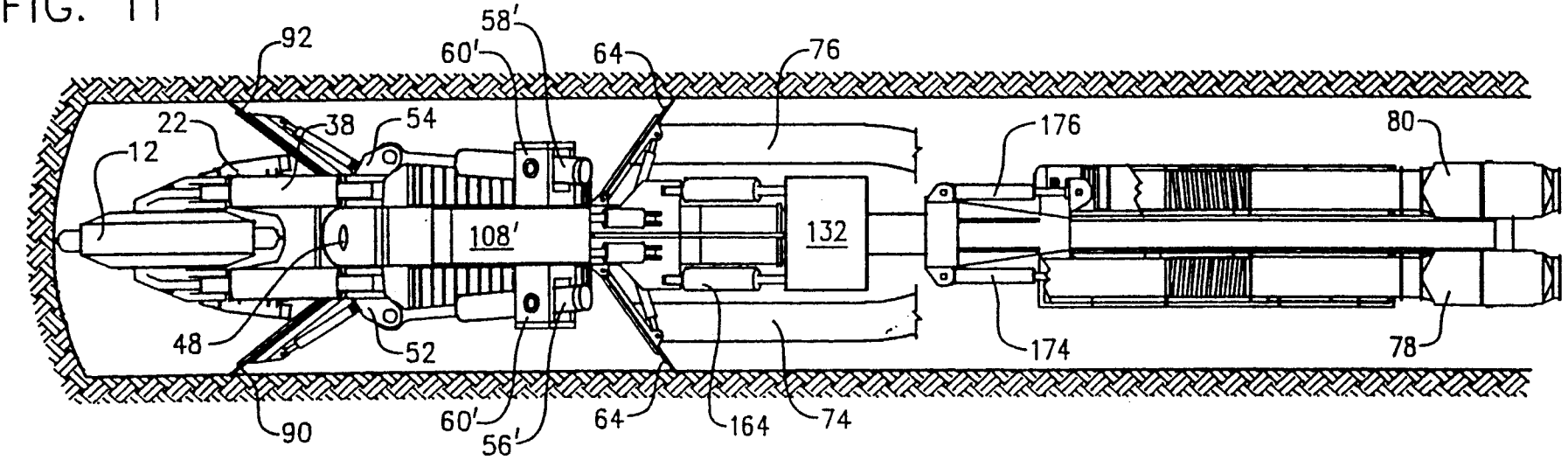
FIG. 11 is a top view of the mobile mining machine of FIG. 10.
Figure 12:
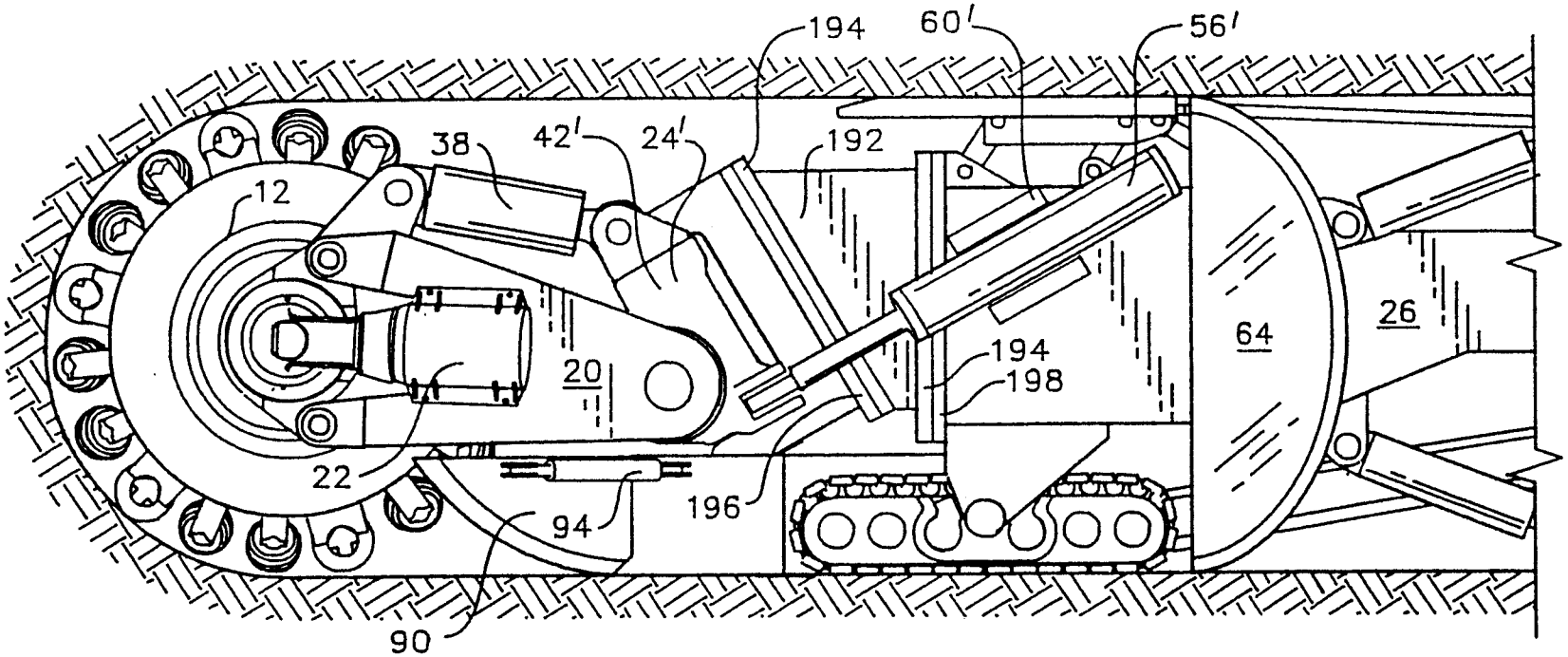
FIG. 12 is an enlarged portion of FIG. 10 showing the front section of the mobile mining machine of FIG. 10.
Figure 13:
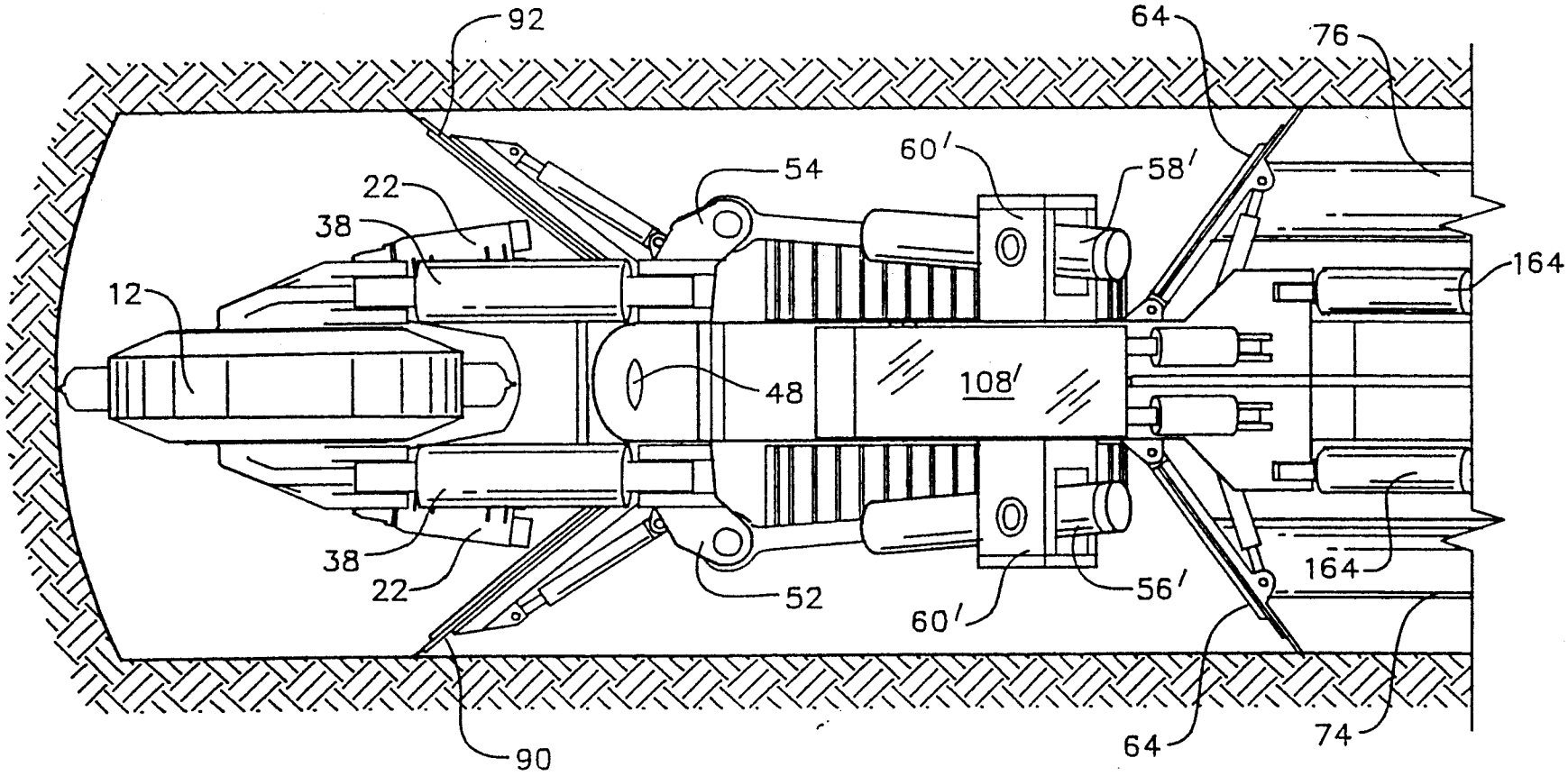
FIG. 13 is an enlarged portion of FIG. 11 showing the front section of the mobile mining machine of FIG. 11.
Figure 14:
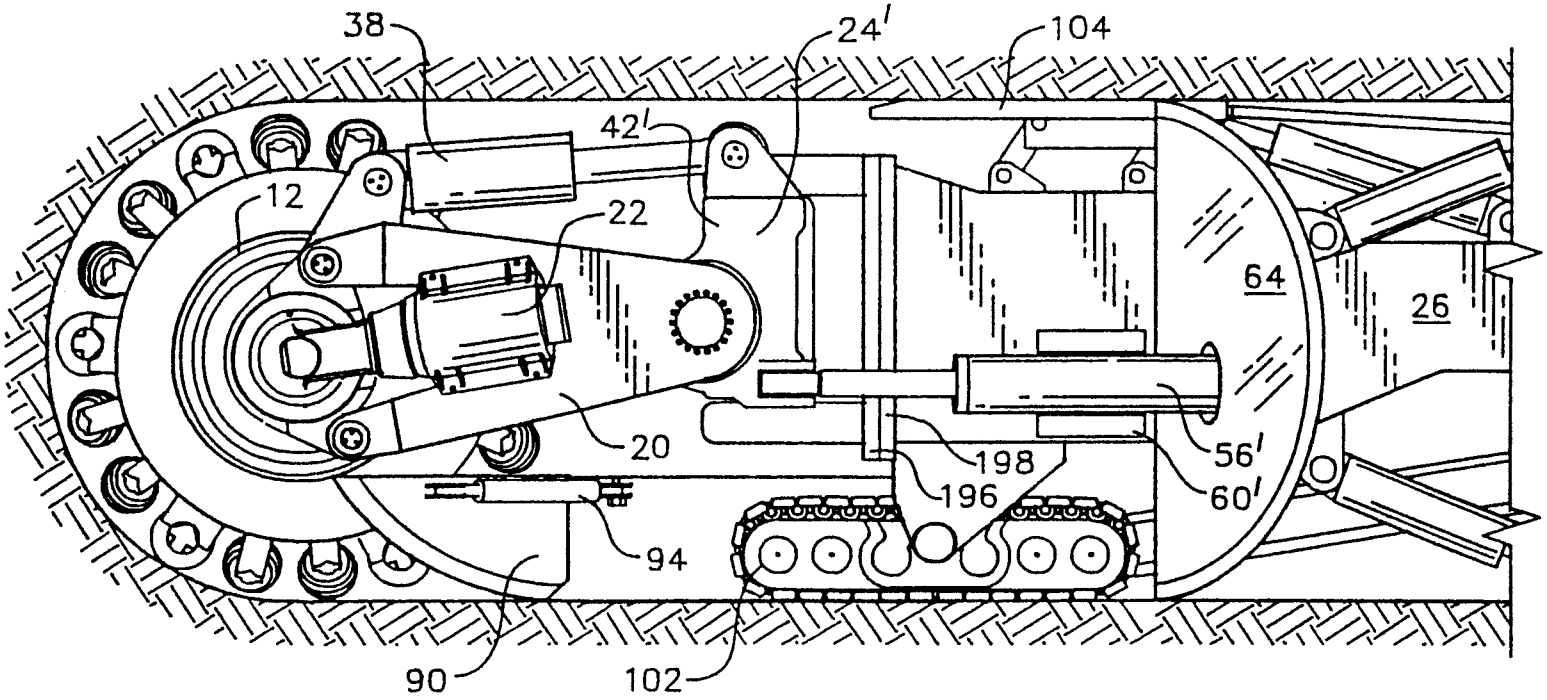
FIG. 14 is a partial side elevational view of the second embodiment of a mobile mining machine showing a convertible swing boom assembly in the vertical swing axis configuration.
Figure 15:
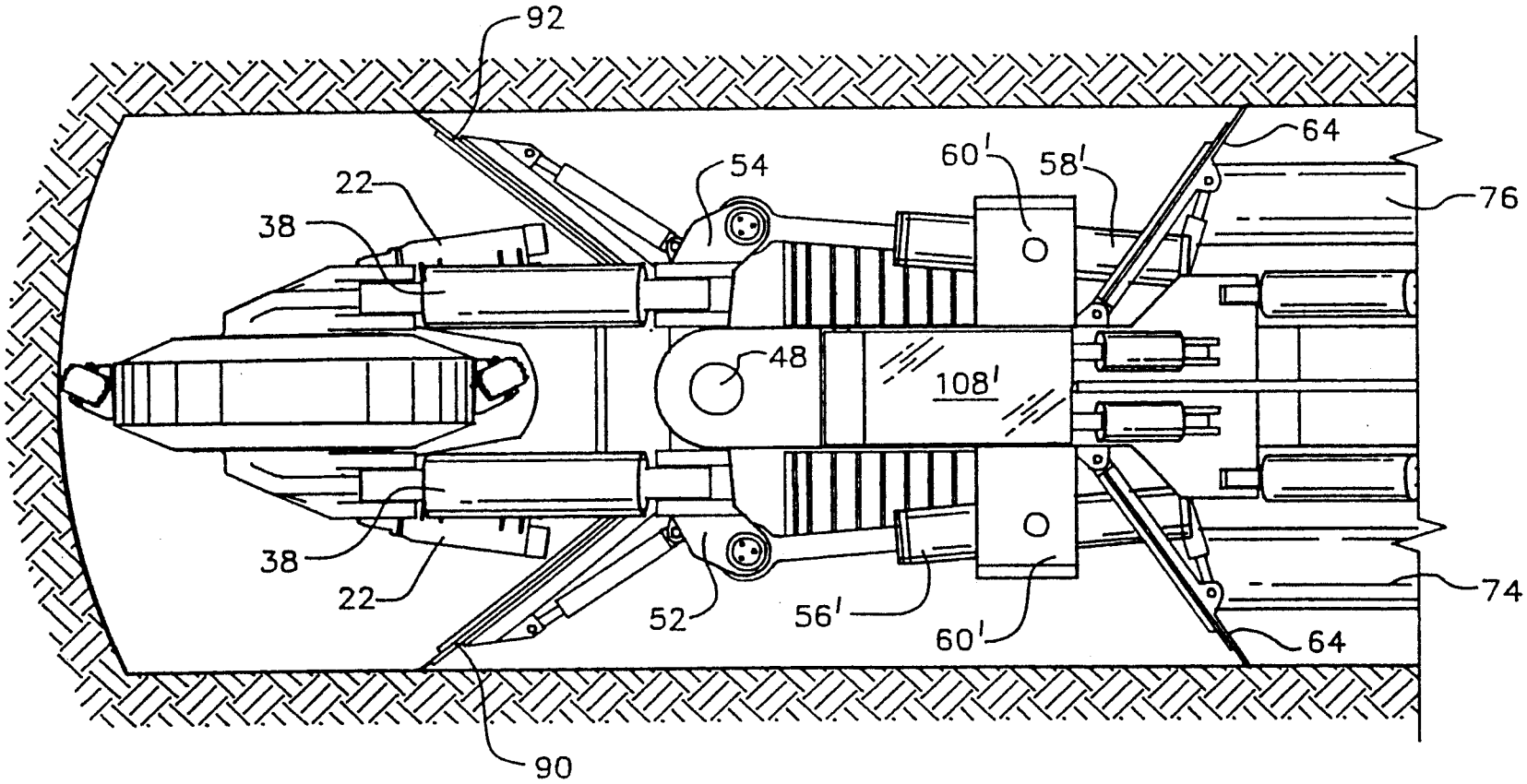
FIG. 15 is a partial top view of the mobile mining machine of FIG. 14.

To configure convertible mobile mining machine 10' in the vertical axis mode, as shown in FIGS. 14 and 15, tilt adapter 192 is removed by disengaging the bolts securing flanges 194 to flanges 196 and 198. Additionally, left swing cylinder 56 and right swing cylinder 58 are moved from their angled configuration, shown in the tilt mode of convertible mobile mining 10', to a substantially horizontal configuration. This conversion is achieved by removing swing cylinder brackets 60' from their tilt mode location on the upper portion of the side of main beam 26' as shown in FIGS. 10 and 12, and securing swing cylinder brackets 60' to the lower portion of the side of main beam 26' as shown in FIG. 14. Swing cylinder brackets 60' are secureable at either of the above two locations by bolts or the like. Alternatively, mobile mining machine 10' can be equipped with two sets of left swing cylinders 56 and right swing cylinders 58, one at each of the tilt mode and vertical mode locations on main beam 26 (not shown).

Figure 16:
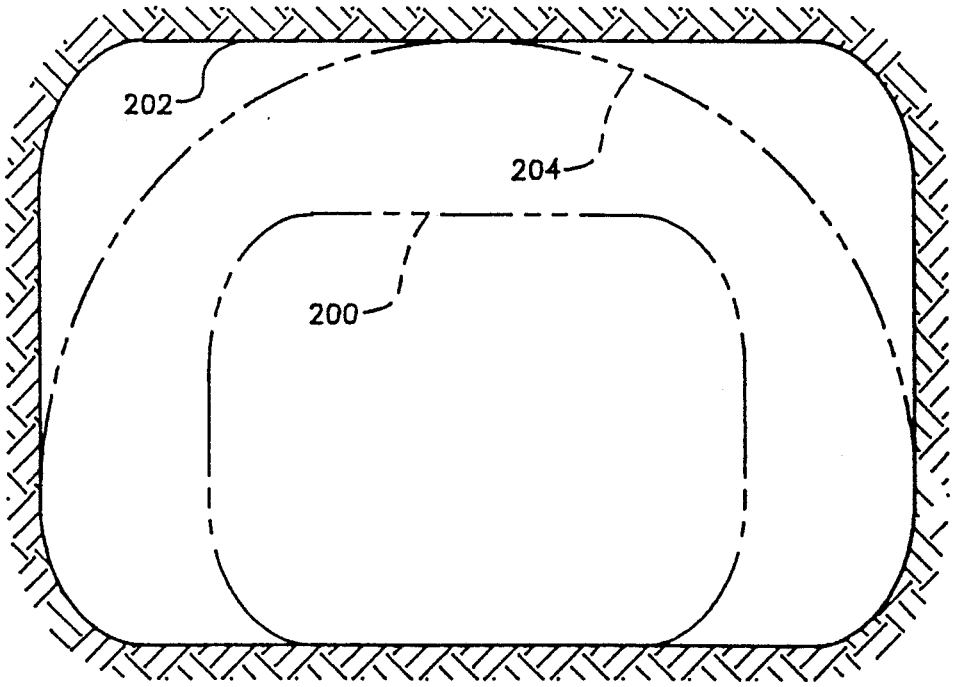
FIG. 16 is a cross-sectional view of the maximum tunnel, the minimum tunnel and an exemplary tunnel cut with the mobile mining machine of FIG. 14.

FIG. 16 show the shapes and relative sizes of the minimum tunnel 200 and the maximum tunnel 202 above to be mined by mobile mining machine 10' in the vertical mode. Tunnel 204 is an exemplary tunnel having a size between that of minimum tunnel 200 and maximum tunnel 202. It is readily apparent, however, that mobile mining machine 10' can mine a tunnel of any shape and size between the minimum tunnel 200 and maximum tunnel 202.

Minimum tunnel 200 is sized such that mobile mining machine 10' can pass therethrough. Thus, the shape and size of minimum tunnel 200 is dictated by the lateral size of mobile mining machine 10'.

Regarding maximum tunnel 202, its width is a function of the travel of swing boom 42' in a horizontal plane. Preferably, the travel of swing boom 42' is about ±45° (or 90° total). The height of maximum tunnel 202 is based on the travel of pitch boom 28 in a vertical plane. Preferably, the travel of pitch boom 28 is about 33°. However the travel may be up to about 45°.

The pitch boom 28 and swing boom 42' travel parameters, and thus the height and width of maximum tunnel 202, are also determined by the diameter of drum 14 of cutterhead assembly 12. Specifically, it is desirable to produce a full cut in the rock face in a maximum of two passes of cutterhead assembly 12. If mobile mining machine 10' extends beyond the above swing and pitch parameters for pitch boom 28 and swing boom 42', three passes of the cutterhead assembly 12 are needed to produce a full cut in the rock face.

Regarding the configuration of maximum tunnel 202 and minimum tunnel 200, the small height-to-width ratios of these tunnels (i.e. wide tunnel with low ceiling) and the avoidance of any arc in the crowns of these tunnels (i.e. flat roof) are achieved by reason of the cutterhead assembly 12 being connected to pitch boom 28, and the pitch boom 28 being connected to swing boom 42'. The above cutterhead assembly/pitch boom/swing boom configurtion results in mobile mining machine 10' being more stable (i.e. "stiffer") for mining a wide tunnel with a low ceiling.

The above described embodiments are intended to be descriptive, not restrictive. The full scope of the invention is described by the claims and any and all equivalents are included.

We claim:

1. A mobile mining machine for cutting a tunnel in rock, comprising:

a wheel-like cutterhead assembly means for cutting rock, said cutterhead assembly means having a subtantially horizontal axis of rotation and having multiple peripherally mounted roller cutter units;

rotation means for rotating said cutterhead assembly means about its horizontal axis;

pitch boom assembly means supporting said cutterhead assembly means, said pitch boom assembly means causing vertical movement of said cutterhead assembly means;

frame means having a longitudinal axis and a vertical axis perpendicular to the longitudinal axis;

swing boom assembly means supported by said frame means and supporting said pitch boom assembly means, said swing boom assembly means having a pivot axis oriented at an acute angle from the vertical axis of said frame means, said swing boom assembly causing lateral movement of said cutterhead assembly means and said pitch boom assembly means with respect to said frame means;

thrust means for thrusting forward as a unit said frame means, said swing boom assembly means, said pitch boom assembly means, and said cutterhead assembly means; and holding means for anchoring said mobile mining machine in a tunnel during activation of said thrust means, said holding means including transport means for locomotion of said mobile mining machine.

2. The mobile mining machine of claim 1, wherein said holding means comprises:

a pair of gripper cylinders interconnected by a floating gripper carrier weldment having an opening in which resides the aft portion of said frame means for relative sliding movement of said floating gripper carrier weldment and said aft portion of said frame means, each of said gripper cylinders having an upper rod with a roof anchor shoe thereon and a lower rod with a floor anchor shoe thereon, said thrust means interconnecting said main frame and said holding means whereby extension of said gripper cylinder braces said holding means against a tunnel and extension of said thrust means moves forward said frame means relative to said holding means as said aft portion of said frame means slides in said floating gripper carrier weldment, and retraction of said gripper cylinders and of said thrust means moves forward said holding means relative to said frame means as said floating gripper carrier weldment slides along said aft portion of said frame means.

3. The mobile mining machine of claim 2, wherein said main frame further comprises:

gripper grooves longitudinally disposed on said aft portion of said frame means, said gripper grooves guiding the relative sliding movement of said floating gripper carrier weldment of said holding means and of said aft portion of said frame means.

4. The mobile mining machine of claim 2, wherein said upper rods of said gripper cylinders are independently . extendable and retractable with respect to said lower rods of said gripper cylinders for altering the vertical orientation of said frame means relative to a tunnel.

5. The mobile mining machine of claim 1, wherein said holding means includes a rolling roof stabilizer and a rear gripper assembly means, said rolling roof stabilizer comprising:

a stabilizer support attached to the top of said frame means;

a plate slidably secured to said stabilizer support by roller means;

plate anchor means between said frame means and said stabilizer support for bracing said plate against the roof of the tunnel upon energizing said plate anchor means;

link means connecting said plate to said rear gripper assembly means whereby (i) said frame means and said stabilizer support move forward on said roller means and relative to said plate upon energizing of said plate anchor means to brace said plate against the roof of the tunnel, anchoring of said rear gripper assembly means in the tunnel, and thrusting of said thrust means, and (ii) said link means moves said plate forward on said roller means during forward movement of said rear gripper assembly means and relative to said stabilizer support and said frame means upon retraction of said plate anchor means, said rear gripper assembly means and said thrust means.

6. The mobile mining machine of claim 1, wherein the acute angle of the pivot axis of said swing boom assembly means is between about 10° and about 45° from the vertical axis of said frame means.

7. The mobile mining machine of claim 6, wherein the acute angle of the pivot axis of said swing boom assembly means is about 30° from the vertical axis of said frame means.

8. A mobile mining machine for cutting a tunnel in rock, comprising:

a wheel-like cutterhead assembly means for cutting rock, said cutterhead assembly means having a substantially horizontal axis of rotation and having multiple peripherally mounted roller cutter units;

rotation means for rotating said cutterhead assembly means about its horizontal axis;

pitch boom assembly means supporting said cutterhead assembly means, said pitch boom assembly means causing vertical movement of said cutterhead assembly means;

frame means having a longitudinal axis and a vertical axis perpendicular to the longitudinal axis;

swing boom assembly means supported by said frame means and supporting said pitch boom assembly means, said swing boom assembly means having a pivot axis, said swing boom assembly causing lateral movement of said cutterhead assembly means and said pitch boom assembly means with respect to said frame means;

removable tilt adaptor means between said swing boom assembly means and said frame means so that the pivot axis of said swing boom assembly is oriented at an acute angle from the vertical axis of said frame means when said removable tilt adaptor is present, and the pivot axis of said swing boom assembly means is substantially parallel to the vertical axis of said frame means when said removable tilt adaptor means is absent;

thrust means for thrusting forward as a unit said frame means, said swing boom assembly means, said pitch boom assembly means and said cutterhead assembly means; and holding means for anchoring said mobile mining machine in a tunnel during activation of said thrust means, said holding means including transport means for locomotion of said mobile mining machine.

9. The mobile mining machine of claim 8, wherein said holding means comprises:

a pair of gripper cylinders interconnected by a floating gripper carrier weldment having an opening in which resides the aft portion of said frame means for relative sliding movement of said floating gripper carrier weldment and said aft portion of said frame means, each of said gripper cylinders having an upper rod with a roof anchor shoe thereon and a lower rod with a floor anchor shoe thereon, said thrust means interconnecting said frame means and said holding means whereby extension of said gripper cylinder braces said holding means against the tunnel wall and extension of said thrust means moves forward said frame means relative to said holding means as said aft portion of said frame means slides in said floating gripper carrier weldment, and retraction of said gripper cylinders and of said thrust means moves forward said holding means relative to said frame means as said floating gripper carrier weldment slides along said aft portion of said frame means.

10. The mobile mining machine of claim 9, wherein said frame means further comprises:

gripper grooves longitudinally disposed on said aft portion of said frame means, said gripper grooves guiding the relative sliding movement of said floating gripper carrier weldment of said holding means and of said aft portion of said frame means.

11. The mobile mining machine of claim 9, wherein said upper rods of said gripper cylinders are independently extendable and retractable with respect to said lower rods of said gripper cylinders for altering the vertical orientation of said frame means relative to the tunnel.

12. The mobile mining machine of claim 8, wherein said holding means includes a rolling roof stabilizer and a rear gripper assembly means, said rolling roof stabilizer comprising:

a stabilizer support attached to the top of said frame means;

a plate slidably secured to said stabilizer support by roller means;

plate anchor means between said frame means and said stabilizer support for bracing said plate against the roof of the tunnel upon energizing said plate anchor means;

link means connecting said plate to said rear gripper assembly means whereby (i) said frame means and said stabilizer support move forward on said roller means and relative to said plate upon energizing of said plate anchor means to brace said plate against the roof of the tunnel, anchoring of said rear gripper assembly means in the tunnel, and thrusting of said thrust means, and (ii) said link means moves said plate forward on said roller means during forward movement of said rear gripper assembly means and relative to said stabilizer support and said frame means upon retraction of said plate anchor means, said rear gripper assembly means and said thrust means.

13. The mobile mining machine of claim 8, wherein the acute angle of the pivot axis of said swing boom assembly means is between about 10° and about 45° from the vertical axis of said frame means.

14. The mobile mining machine of claim 13, wherein the acute angle of the pivot axis of said swing boom assembly means is about 30° from the vertical axis of said frame means.

15. A mobile mining machine for cutting a tunnel in rock, comprising:

a cutterhead for cutting rock, said cutterhead having a substantially horizontal axis of rotation and having multiple peripherally mounted roller cutter units;

rotation means for rotating said cutterhead about its horizontal axis;

a pitch boom supporting said cutterhead, said pitch boom causing vertical movement of said cutterhead;

a main frame having a longitudinal axis and a vertical axis perpendicular to the longitudinal axis;

a swing boom supported by said main frame and supporting said pitch boom, said swing boom having a pivot axis oriented at an acute angle from the vertical axis of said main frame, said swing boom causing lateral movement of said cutterhead and said pitch boom with respect to said main frame;

thrust means for thrusting forward as a unit said main frame, said swing boom, said pitch boom and said cutterhead; and holding means for anchoring said mobile mining machine in a tunnel during actuation of said thrust means, said holding means including a pair of griper cylinders interconnected by a floating gripper carrier weldment having an opening in which resides the aft portion of said main frame for relative sliding movement of said floating gripper carrier weldment and said aft portion of said main frame, each of said gripper cylinders having an upper rod with a rood anchor shoe thereon and a lower rod with a floor anchor shoe thereon, said thrust means interconnecting said main frame and said holding means whereby extension of said gripper cylinder braces said holding means against a tunnel and extension of said thrust means moves forward said main frame relative to said holding means as said aft portion of said main frame slides in said floating gripper carrier weldment, and retraction of said gripper cylinders and of said thrust means moves forward said holding means relative to said main frame as said floating gripper carrier weldment slides along said aft portion of said main frame, said holding means including transport means for locomotion of said mobile mining machine.

16. The mobile mining machine of claim 15, wherein said main frame further comprises:

gripper grooves longitudinally disposed on said aft portion of said main frame, said gripper grooves guiding the relative sliding movement of said floating gripper carrier weldment of said holding means and of said aft portion of said main frame.

17. The mobile mining machine of claim 15, wherein said upper rods of said gripper cylinder are independently extendable and retractable with respect to said lower rods of said gripper cylinders for altering the vertical orientation of said main frame relative to a tunnel.

18. The mobile mining machine of claim 17, further including a rolling roof stabilizer, said rolling roof stabilizer comprising:

a stabilizer support attached to the top of said main frame;

a plate slidably secured to said stabilizer support by roller means;

plate anchor means between said main frame and said stabilizer support for bracing said plate against the roof of the tunnel upon energizing said plate anchor means; and link means connecting said plate to said holding means whereby (i) said main frame and said stabilizer support move forward on said roller means and relative to said plate upon energizing of said plate anchor means to brace said plate against the roof of the tunnel, anchoring of said rear gripper assembly means in the tunnel, and thrusting of said thrust means, and (ii) said link means moves said plate forward on said roller means during forward movement of said rear gripper assembly means and relative to said stabilizer support and said main frame upon retraction of said plate anchor means, said rear gripper assembly means and said thrust means.

19. The mobile mining machine of claim 15, wherein the acute angle of the pivot axis of said swing boom is between about 10° and about 45° from the vertical axis of said main frame.

20. The mobile mining machine of claim 19, wherein the acute angle of the pivot axis of said swing boom is about 30° from the vertical axis of said main frame.

21. A rolling roof stabilizer for a mobile mining machine having a rear gripper assembly movable on a main frame and having thrust means, said rolling roof stabilizer comprising:

a stabilizer support attached to the top of the main frame;

a plate slidably secured to said stabilizer support by roller means;

plate anchor means between the main frame and said stabilizer support for bracing said plate against the roof of the tunnel upon energizing said plate anchor means; and link means connecting said plate to the rear gripper assembly whereby (i) the main frame and said stabilizer support move forward on said roller means and relative to said plate upon energizing of said plate anchor means to brace said plate against the roof of the tunnel, anchoring of the rear gripper assembly in the tunnel, and thrusting of the thrust means, and (ii) said link means moves said plate forward on said roller means during forward movement of the rear gripper assembly and relative to said stabilizer support and the main frame upon retraction of said plate anchor means, the rear gripper assembly means and the thrust means.

22. A method of cutting a tunnel having a flat floor that is wider than the tunnel roof with a mobile mining machine comprised of a wheel-like cutterhead assembly means for cutting rock having multiple peripherally mounted roller cutter units, means for rotating said cutterhead assembly about its horizontal axis, pitch boom assembly means supporting said cutterhead assembly means and causing vertical movement of said cutterhead assembly means, frame means having a longitudinal axis and a vertical axis perpendicular to the longitudinal axis, swing boom assembly means supported by said frame means and supporting said pitch boom assembly means, said swing boom assembly means having a pivot axis oriented at an acute angle from the vertical axis of said frame means such that said swing boom assembly causes lateral movement of said cutterhead assembly means and said pitch boom assembly means with respect to said frame means, thrust means for thrusting forward as a unit said frame means, said swing boom assembly means, said pitch boom assembly means and said cutterhead assembly means, and holding means for anchoring said mobile mining machine in the tunnel during energizing of said thrust means, said holding means including transport means for locomotion of said mobile mining machine, said method comprising the steps of:

extending said holding means to contact the tunnel walls;

energizing said cutterwheel assembly means to rotate said roller cutter units about the horizontal axis of said cutterwheel assembly means;

energizing said pitch boom assembly means to vary the pitch of said cutterwheel assembly means relative to the tunnel work face;

extending said thrust means to force said frame means forward along the tunnel relative to said holding means;

energizing said swing boom assembly means to sweep said cutterwheel assembly means across the tunnel work face;

retracting said holding means from the tunnel walls; and retracting said thrust means to draw said holding means forward relative to said frame means.

* * * * *